US007207126B2

(12) United States Patent
Gantier

(10) Patent No.: US 7,207,126 B2
(45) Date of Patent: Apr. 24, 2007

(54) MOVABLE COVER FOR RIGIDIFYING AND/OR PROTECTING THE FRONT FACE OF AN ARTICLE OF FOOTWEAR, SUCH AS A SNOWBOARD BOOT

(75) Inventor: Alain Gantier, Rumilly (FR)

(73) Assignee: Salomon S.A., Metz-Tessy (FR)

( * ) Notice: Subject to any disclaimer, the term of this patent is extended or adjusted under 35 U.S.C. 154(b) by 4 days.

(21) Appl. No.: 09/937,016

(22) PCT Filed: Jan. 22, 2001

(86) PCT No.: PCT/FR01/00199

§ 371 (c)(1),
(2), (4) Date: Sep. 20, 2001

(87) PCT Pub. No.: WO01/52679

PCT Pub. Date: Jul. 26, 2001

(65) Prior Publication Data

US 2002/0133979 A1 Sep. 26, 2002

(30) Foreign Application Priority Data

Jan. 24, 2000 (FR) ..... 00 00847

(51) Int. Cl.
*A43B 13/22* (2006.01)

(52) U.S. Cl. ..... 36/72 R; 36/54; 36/117.1

(58) Field of Classification Search ..... 36/72 R, 36/54, 117.1, 77 R, 115, 7.1 R, 7.2, 99; D2/909, 913
See application file for complete search history.

(56) References Cited

U.S. PATENT DOCUMENTS 2,249,553 A * 7/1941 Cataffo ..... 36/72 R
D157,124 S * 2/1950 Boughey ..... D2/913
3,068,593 A * 12/1962 O'Donnell ..... 36/72 R
3,108,386 A * 10/1963 MacQuaid ..... 36/72 R
3,206,874 A 9/1965 Ellis et al. ..... 36/72
3,334,427 A * 8/1967 Edwards et al. ..... 36/72 R
3,561,142 A * 2/1971 Streit, Sr. et al. ..... 36/72 R
3,783,534 A * 1/1974 Phillips et al. ..... 36/72 R
3,849,914 A 11/1974 Bertele ..... 36/2.5 AL
4,177,583 A * 12/1979 Chapman ..... 36/72 R (Continued)

FOREIGN PATENT DOCUMENTS

DE 2429652 1/1976

(Continued)

*Primary Examiner*—Jila M. Mohandesi
(74) *Attorney, Agent, or Firm*—Greenblum & Bernstein, P.L.C.

(57) ABSTRACT

A device including a cover and a shaft inserted in the thickness of the front portion of the sole, and constituting a journalled system, adapted to ensure control of the flexural rigidity of a shoe, in particular a snowboard boot, or adapted to ensure the protection of the front surface of the shoe, partially or in its entirety. All of the elements forming the system can be removable. The journal which it determines provides the cover with a front-to-rear mobility which is presented, in closed position, against the front surface of the shoe. Connected to the latter by a retaining mechanism specific to the shoe, the cover offers, due to the properties and the shaping of its constituent materials, a resistance to the crushing and flexural and torsional deformation of the shoe in its front portion during use.

46 Claims, 4 Drawing Sheets

U.S. PATENT DOCUMENTS 4,231,170 A * 11/1980 Griswold ..... 36/72 R
4,788,782 A * 12/1988 Pozzebon et al. ..... 36/117.9
5,272,822 A 12/1993 Diaz ..... 36/2 R
5,701,688 A * 12/1997 Crowley ..... 36/72 R
5,711,092 A * 1/1998 Despres et al. ..... 36/72 R
5,971,423 A 10/1999 Hansen et al. ..... 280/634
6,360,454 B1 * 3/2002 Dachgruber et al. ..... 36/54
6,408,542 B1 * 6/2002 Shepherd ..... 36/54

FOREIGN PATENT DOCUMENTS

| | | |
|---|---|---|
| EP | 0582552 | 2/1994 |
| EP | 1023848 | 8/2000 |
| FR | 2361837 | 3/1978 |
| FR | 2758468 | 7/1998 |

* cited by examiner

OPEN

CLOSED

MOVABLE COVER FOR RIGIDIFYING AND/OR PROTECTING THE FRONT FACE OF AN ARTICLE OF FOOTWEAR, SUCH AS A SNOWBOARD BOOT

BACKGROUND OF THE INVENTION

1. Field of the Invention

The present invention relates to the addition to an article of footwear and more particularly a snowboard boot, of a system for stiffening and/or protecting the front surface of the article of footwear. This system is constituted by a front cover, which is removable or irremovable, rigid or semi-rigid, and by a device serving as an attachment point therefor, which is inserted into, beneath, or on both sides of the front half of the sole, enabling the system to be affixed temporarily or permanently to the article of footwear, independently of the vamp or upper, while enabling front-to-rear mobility of the cover with respect to this attachment point.

This novelty can lend itself to applications in various fields:

- shoes requiring protection for the vamp, instep, and tibia;
- safety boots;
- motorcycle boots or the like;
- shoes requiring the foot to be supported with variable rigidity;
- protection and/or support of the ankle or the forefoot;
- shoes requiring a power of transmission of the forces to which they are subjected by limiting the loss or lack of focus of energy associated with the deformation, while ensuring comfort and plantar sensitivity for their user; and
- shoes for leisure and roller sports, hiking, and more particularly shoes adapted to be affixed to a sports apparatus, especially for gliding sports, cross-country skiing, alpine skiing, snowboarding, but also for other sporting activities such as snowshoeing, etc.

The present development applies to the addition of the device to a snowboard boot or shoe, but is of course not limited to such an application.

2. Description of Background and Pertinent Information

The current techniques attempt to combine a satisfactory user's comfort, warmth, imperviousness, flexibility, absence of hard spots in the liner, light plantar sensations, with a rigidity of the footwear which satisfactorily responds to the mechanical stresses, forces exerted on the binding, on the board, and to the biomechanical stresses, optimum transmission of the forces from the snowboarder to the board.

These techniques propose solutions which unevenly deal with the rigidity to comfort ratio. Indeed, either the flexural rigidity of the shoe is high and the shoe has a heavy and rigid sole, which hinders plantar sensations, comfort when putting on or removing both the shoes and the snowboard, and ease of walking, or the flexural rigidity of the boot is low, and the shoe can be comfortable, but the force transmission quality is poor. Thus, the rigidity in extension, via the support of the rear surface of the leg on the rear upper, causes a lift of the forefoot, which, depending on the forces exerted, causes a torsional deformation of the shoe. In addition, any attempt to resolve these problems most often calls for an increase in the number of pieces or inserts necessary to hold the foot, both on the shoe and on the board and its binding, which hinders the ease and pleasure in using the assembly.

Finally, the existing systems are not very adaptable, do not allow any rigidity adjustment, etc., and cause the boot to be highly specific with respect to the diversity in the current snowboarding practices.

Currently, three shoes or boots/bindings principles can be distinguished. The first, which is the oldest, consists of a flexible boot, with no particular reinforcement, whose rigidity is provided by the so-called "shell" binding system mounted entirely on the board. It has a device for affixing the shoe on the board, constituted of a rigid plate positioned flat on the board ensuring the boot/board connection, which supports, in its rear portion, a rear cover or spoiler ensuring the rear support of the boot, a system of straps or ratchets holding the heel by covering the instep/ankle juncture and, in its median or front portion, another strap or ratchet holding the forefoot against the aforementioned plate.

The second principle, so called "step-in," has a binding system which only affixes the shoe and the snowboard. The shoe then has reinforcements inside the footwear in the form of plastic inserts located only between the rear upper and the liner (integrated spoiler), a more rigid sole than the previous one, and external reinforcements in the form of straps latching the upper portion of the ankle and the instep.

The last principle is a combination of the previous ones, wherein the rear upper reinforcement is seen, either on the binding, or fixed externally to the rear surface of the shoe. These two last principles have a generally higher rigidity than the first boots/bindings principle for a greater weight as well, a loss of gliding plantar sensations and a flexural rigidity directly associated with the aging of the material constituting the footwear and with the intensity of the activity.

SUMMARY OF THE INVENTION

The object of the present invention is to overcome the aforementioned disadvantages, and more particularly to propose a solution to the problem of controlling the front-to-rear rigidity of the shoe, while preserving an optimum plantar sensitivity.

Another object of the present invention is to also provide an adaptable system making it possible to vary the flexural stiffness of the shoe as a function of the intended use, or yet as a function of the user.

A last object of the present invention is to provide a shoe construction enabling an optimum transmission of the forces from the user's leg to the sports apparatus.

The invention is directed more particularly to a movable and/or detachable front cover assembly, which can be referred to as "front spoiler" in relation to the rear spoilers which nowadays equip the snowboard boots or their binding, and to its attachment to the front portion of the boot sole.

According to the invention, this cover or stiffening device is capable of covering the front surface of the shoe, and extends from the flexion fold zone up to the front end zone of the sole.

The cover, of variable shapes and rigidity, interchangeable or fixed, can cover and completely or partially hold the instep and/or the instep and the bottom of the front surface of the leg.

Its bilateral method of attachment to the shoe, according to one of the embodiments, determines therefor a front-to-rear travel that makes it possible to define an open position which completely releases the vamp and allows putting on/removing the shoe, lacing/unlacing or any other tightening/loosening method, while remaining affixed to the front end of the shoe.

By folding the cover against the front portion of the boot, a closed position is defined during which, depending on its form, it can completely or partially cover the front portion of the boot. It then partially or completely covers the footwear tightening system and protects it.

It is affixed to the rear upper or to a spoiler, dependent on or independent of the shoe, by one or more existing arrangements of straps and/or buckles or hooks, which immobilize its upper portion. It can itself constitute the support, completely or partially, of this same material. This configuration makes it possible to affix the front and rear surfaces of the shoe with a degree of cohesion selected by the user during tightening, from a substantial stiffness up to a substantial flexibility.

In the case of a detachable fixing method, the possibility to quickly replace a cover of different shape and/or rigidity enables the shoe characteristics to be adapted to the snowboarding levels and conditions. Thus, a plurality of different covers, having different shapes and/or different rigidities, can be associated with the same shoe.

Finally, the cover itself can have movable parts, arms journalled to the cover by riveting, enabling it to adapt to the various boot volumes and/or sizes. The cover is manually actuated.

The method of attaching the cover on the boot can be fixed or detachable. In any case, the cover is attached on the sole irrespective of the vamp and is housed beneath, inside, or on both sides of the sole in its plantar portion.

Beneath the sole, the insert for attaching the cover can be constituted of a shaft, whose technical characteristics will be detailed subsequently, arranged transversely with respect to the longitudinal axis of the shoe, and its trajectory cuts into the wear surface of the sole. If the attachment insert is housed within the latter, a recess is provided in the sole to ensure the passage and retention of the shaft.

The front end of the cover, composed of two lateral arms or legs each bored with a hole having the diameter of the shaft, is affixed to each end of the shaft by a nut, if the ends of the shaft are threaded, or by clipping, or by any other retaining method. If the surfaces selected for insertion are the lateral edges of the sole, two non-traversing inserts are positioned by partial boring of the sole, and the cover is fixed thereto as previously, or by a tenon/mortise system, or by snap fastener, or by any other attachment method.

The various devices for fixing the cover form the journal that provides the cover with its front-to-rear mobility, already described, and makes it possible to define the aforementioned opened/closed positions. In the case where the cover is fixed to a transverse shaft extending through the front of the sole at a level located at the base of the toes, this shaft contributes to ensuring the lateral and torsional rigidity of the front of the shoe while preserving in the sole the flexibility necessary to the plantar sensations.

The assembly of the elements described has a removable system affixed to the boot, enabling the boot to resist the deformation by crushing in bending.

The definitions of the constituent elements of the invention make it possible to bring out the characteristics of the improvement made to the shoe by adding this system. It improves the mechanical and comfort properties of the boot.

Mechanical properties include the following: high rigidity which can be adjusted by tightening and/or replacement of the cover by a cover of different rigidity; increase in the flexural rigidity; synergic operation of the cover and of the rear upper; torsional rigidity of the front of the sole without hardening, and preservation of the plantar sensations; improved transmission of the forces to the board by the cohesion of the shoe assembly and a more direct transmission of the forces from the leg down to the foot.

Comfort properties include the following: the footwear and liner can be made lighter; the front portion of the boot can be flexible; the cover protects the integrity of the lacing system and can protect from the cold, frost, rain, etc. A certain lateral flexibility in the ankle zone can be preserved. The device can be adapted to the size and/or to the volume of the shoe by mounting movable arms. The simplicity of the device makes it very easy to use and highly reliable.

BRIEF DESCRIPTION OF THE DRAWINGS

In any event, the invention will be better understood by means of the description that follows, with reference to the annexed schematic drawings showing, by way of non-limiting examples, an example of a preferred embodiment, and in which.

DETAILED DESCRIPTION OF THE INVENTION

Figure 1:
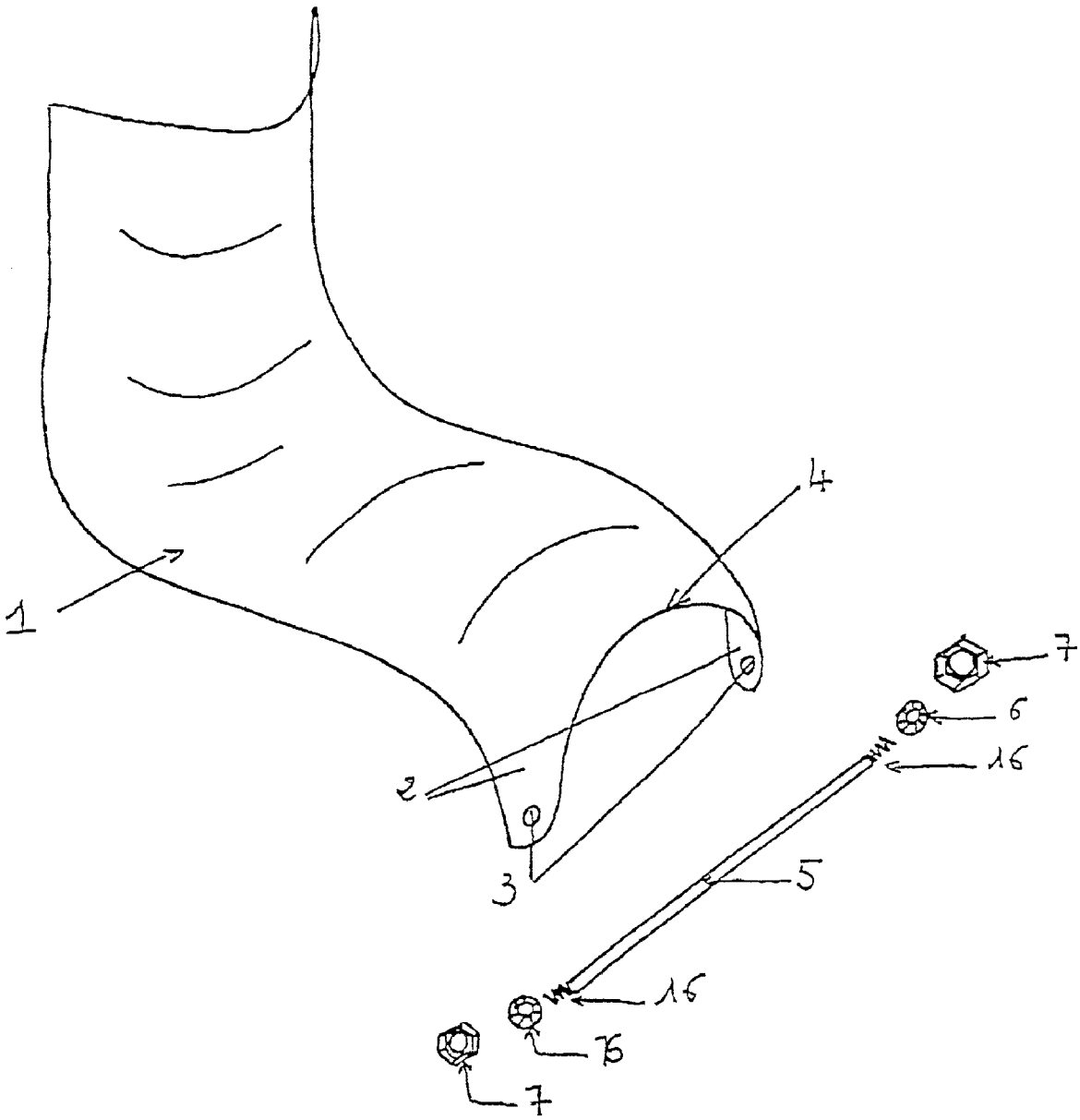
FIG. 1 is an exploded perspective view of the various elements forming the stiffening device.

FIGS. 1–5 show a shoe 10, in this case adapted to snowboarding, equipped with a cover 1 according to the invention. This cover 1 substantially has the shape of a tile capable of covering the front portion, i.e., the front of the shoe 10, from its tibial support zone 20 up to its front end zone 22, including the flexion fold zone 21. The cover 1 is extended at the front by two lateral arms 2 extending to the area of the sole 9 of the shoe. As explained in more detail below, the cover 1 is fixed to the sole 9 of the shoe in the zone of the metatarsophalangeal joint or of the base of the toes via its lateral arms 2, on the one hand, and to the upper of the shoe 10 in the area of the flexion fold 21 and/or of the tibial support by tightening straps 13 of a known type, on the other hand.

Figure 2:
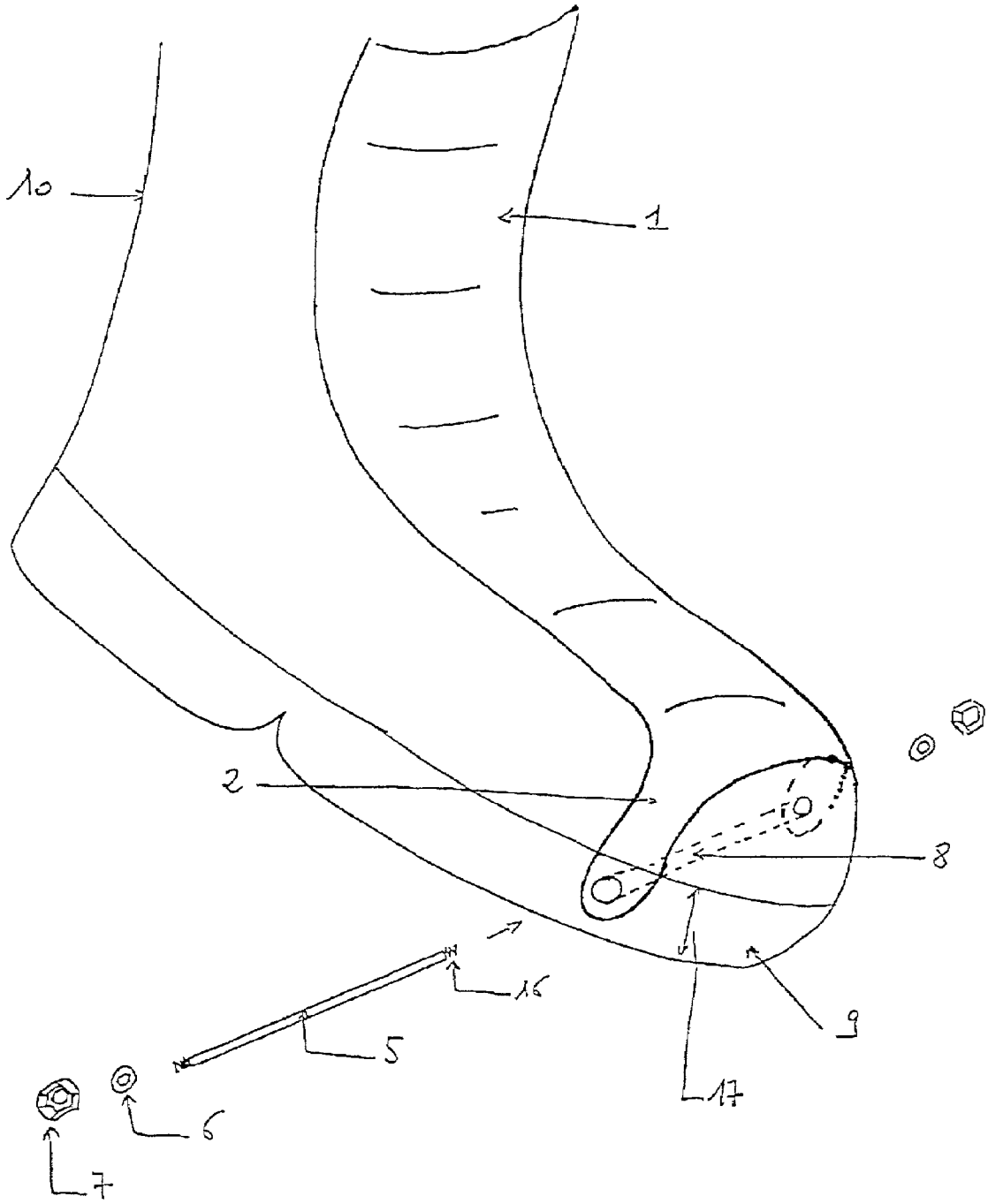
FIG. 2 is a perspective view of the shoe and shows the trajectory of the channel 8 provided within the sole and the presentation of the shaft that is housed therein.
Figure 3:
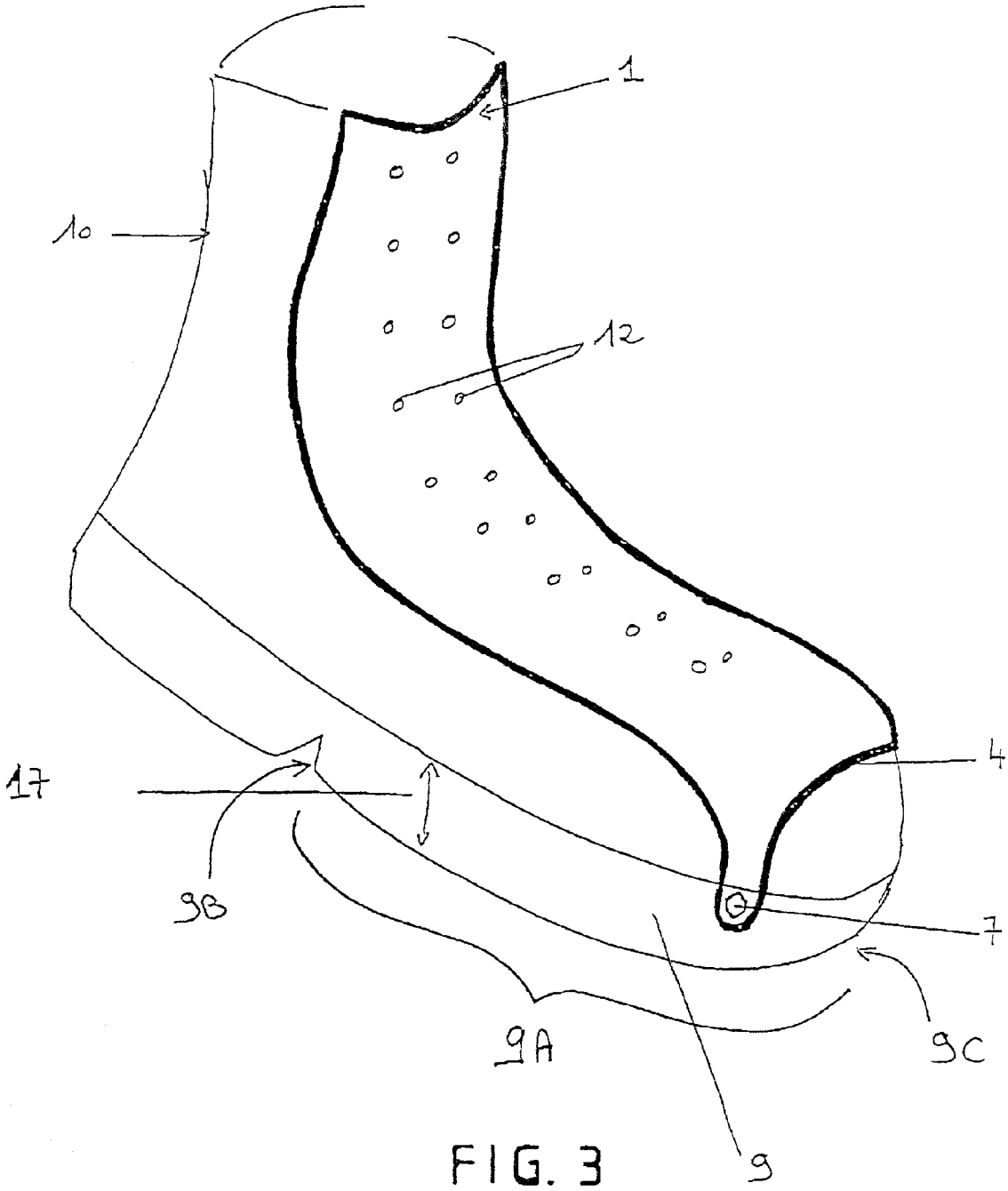
FIG. 3 is a view similar to FIG. 2 and shows the device in position, the cover 1 being folded over the keepers which receive the lacing system, the definition of the thickness of the sole 17 and of the front arch 4 connecting the two arms 2.

With reference to FIGS. 2 and 3, for example, the cover 1 can be said to include three parts, namely, an upper part, an intermediate part, and a lower part. The upper part covers an upper front zone of the upper of the shoe 10, also referred to above as the tibial support zone 20 of the upper. The intermediate part of the cover 1 covers the flexion fold zone 21 of the upper. The lower part of the cover 1 extends forwardly from the flexion fold zone through the front end zone 22 of the upper. Further, in the embodiments shown in the drawings, the cover 1 includes a single piece of material along its length.

Furthermore, the cover 1 covers the zone 12 for closing, in particular by lacing, the front portion of the upper. As shown in the example shown in FIG. 3, the contour of the longitudinally extending edge of the cover 1 generally follows the contour of the longitudinally extending closing zone 12.

The cover 1 can have a wide variety of shapes, sizes, contours, enabling the guiding and/or insertion of belts, straps, slots, materials, in order to obtain the desired level of rigidity.

Figure 4:
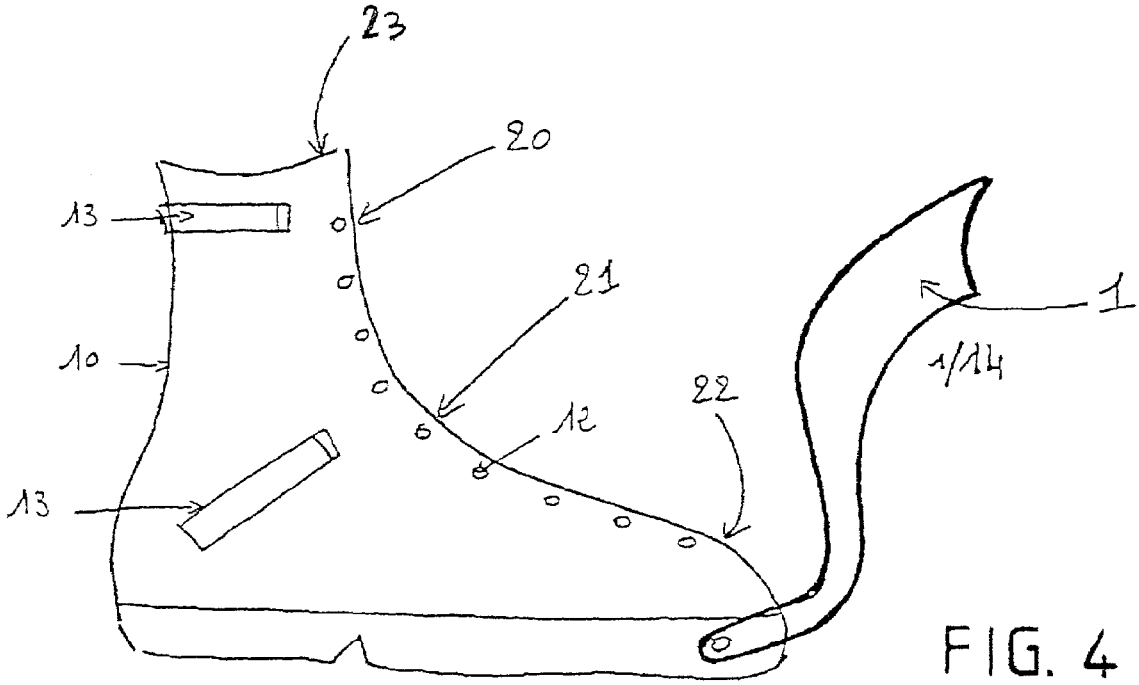
FIGS. 4 and 5 are side views of the shoe and show the tilting of the cover 1 defining the aforementioned open (FIG. 4) and closed (FIG. 5) positions, and the positioning of the already existing tightening means which functionally ensure the fixing of the device in its upper portion.
Figure 5:
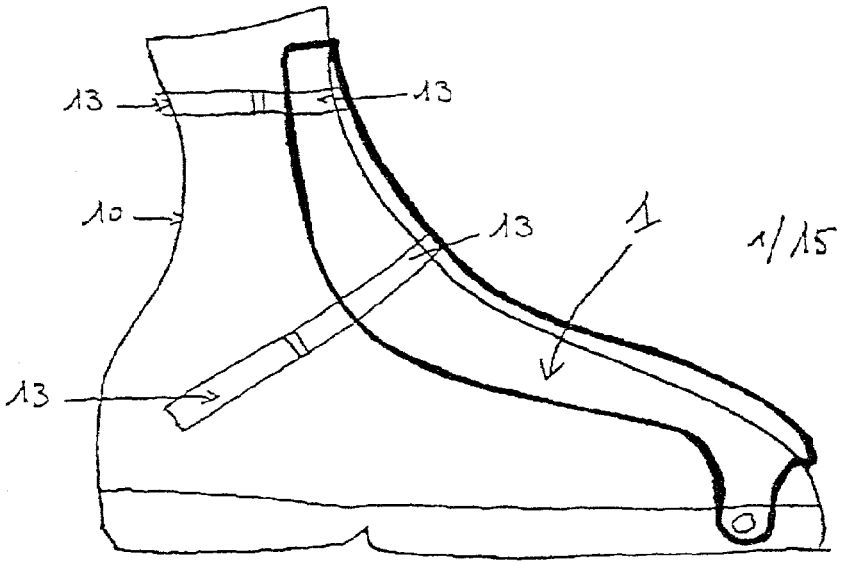

In any event, the cover 1 has a generally anatomical shape corresponding to the front portion of the boot which it must cover in closed position (FIG. 5). That is, as is evident in the drawing figures, the cover has a generally concave contour, in transverse cross section, along its length. A cover 1 made by molding or by thermoforming of a rigid or semi-rigid plastic currently offers a possible solution. Other materials, in particular composite materials, can lend themselves to other applications. As shown in FIG. 4, in the open position, the cover has sufficient rigidity to retain its shape when pivoted forwardly away from the shoe.

The upper limits in the height of the cover 1 enable it to extend to the maximum from the tip of the foot 22 to the top 23 of the upper 10 of the boot, without overlapping neither the latter for reasons of comfort, nor the tip of the foot to enable a 1/14 tilting that releases the vamp in the case where the cover is pivotally mounted.

The maximum lateral limits of the cover 1 can be located at the upper edges of the sole 9 for the vamp and the instep. As shown in the example of the side view of FIG. 5, however, the spacing between lower edge of the cover 1 and the sole 9 progressively increases in a rearward direction, whereby, the cover 1 is spaced above a median part of the sole 9 a distance greater than a distance the cover 1 is spaced above the sole at the front end zone of the shoe 10.

In the embodiment shown where the cover is journalled, it has, at its front end, two arms 2 made of the same material and without interruption of the material, or legs, each bored with a hole 3, or bearing a tenon or mortise or snap fasteners or other types of fastening means. In the example, the arms are bored. They are directed toward the lateral edges of the sole so as to connect to the lateral ends of the insert(s) 5 carried by the sole. Therefore, as can be seen in FIGS. 2–5, the cover 1 is articulated to the sides of the sole, that is, between the top and bottom of the sole. At the front end of the cover, an arch 4 made of the same material and without interruption of material, joins these two arms 2.

The sole insert 5 is, for example, inside the sole 9, and extends through this insertion method having a lateral and torsional stiffening of the front sole. It is in the form of a shaft. It can be metallic, plastic or the like, rigid, semi-rigid, or even flexible in the case of a cable. Its ends 16, flush with the outside of the lateral edges 17 of the sole 9 are, in the example, provided with a threading 16 enabling the arms 2 of the cover 1 to be fixed. This shaft can extend through the sole 9 in a forward zone 9A of the latter, going from the front end of the plantar arch 9B up to the front end 9C of the sole.

In the case of a rigid shaft, by way of example, it seems that a diameter of 4 millimeters represents a maximum such that the latter is not felt by the user.

In the example shown, the shaft 5 transversely extends through the sole 9 in the area of the toes for comfort and optimum efficiency in torsion. The installation of this shaft 5 can be undertaken during molding when the sole is constructed, by installing or making a permanent hollow channel 8 receiving the latter, enabling a free clearance in sagittal rotation of the shaft and/or its replacement or extraction, temporary or permanent. The shaft 5 can also be introduced after boring a channel 8 having the diameter of the shaft 5 in the thickness of the sole 9.

The attachment of the cover 1 on the shaft 5 is accomplished in the following manner: in the example, the holes 3 bored at the end of each arm 2 are each housed around the flush and threaded ends 16 of the shaft 5 and are maintained therein by an anti-loosening washer 6 and a nut 7 which covers each end 16 of the shaft 5. Each arm 2 is affixed to the shoe by tightening the nuts 7 sufficiently to prevent loosening and to avoid deforming the shoe. The pivoting of the cover 1 in a front-to-rear direction is then possible by mere manual action. The inner surface of the arms 2 rests against the lateral edges of the sole 17.

The entire device described finds its industrial application in the field of boots in general, boots for leisure and sports, and more particularly in the field of boots for practicing a sport by means of an apparatus to which said shoes are affixed; a non-limiting example thereof is the snowboard boot. In this case, it can be adapted to almost all of the existing models.

Of course, and as explained hereinabove, the present invention is not limited to the embodiment described. Thus, the cover can be fixed in a removable manner, and can be provided to be interchangeable with a cover of different rigidity for an adaptation to a different activity or user. The method of fixing the cover on the sole can also obtained differently, either on the sides thereof, or by a traversing insert in a form that is not necessarily cylindrical.

The invention claimed is:

1. An assembly comprising:

a shoe and a device for flexural stiffening of the shoe;

said shoe comprising:

an upper including a flexion fold zone, a tibial support zone having an upper front surface, and a flexible front end zone; and a sole;

said device including a rigid or semi-rigid cover covering said upper front surface of said shoe and extending from within said flexion fold zone of said shoe to said front end zone of said shoe;

said cover being fixed to the sole beneath said front end zone of said upper and between the top and bottom of the sole for articulation relative to the sole;

said cover being fixed to the upper of the shoe at said flexion fold zone and/or to said tibial support zone;

said cover being more rigid than said upper front surface and said flexion fold zone of the shoe so as to interfere with free flexing of the shoe in said flexion fold zone while a wearer's foot is positioned within the shoe.

2. An assembly according to claim 1, wherein:

said rigid or semi-rigid cover is a rigid cover.

3. An assembly according to claim 1, wherein:

said cover comprises a single piece of rigid material along an entirety of a longitudinal extent of said cover.

4. A device for flexural stiffening of an upper of a shoe, including a device for a sports shoe adapted to be fixed onto a sports apparatus, said device comprising a cover configured and arranged to cover a front surface of the shoe and to extend from a tibial support zone of the upper of the shoe, through a flexion fold zone of the upper of the shoe to a front end zone of a sole of the shoe, said cover being made of a rigid or semi-rigid material in an entirety of a longitudinal extent of said cover, and at least one connection for connecting the cover to the upper of the shoe at least one of the flexion fold zone and the tibial support zone, and a connection for connecting the cover to the front end zone of the sole of the shoe between a top and a bottom of the sole for articulation of the cover relative to the sole.

5. A device according to claim 4, wherein said connections comprise a journal connection for connecting the device to the sole of the shoe.

6. A device according to claim 5, wherein the cover has a pseudo-anatomical shape corresponding to said front surface of the shoe, capable of covering the shoe completely or partially.

7. A device according to claim 4, wherein the device is configured to be removably mounted to the shoe.

8. A device according to claim 4, wherein the device extends from the tibial support zone to a metatarsophalangeal articulation zone and/or the zone of the base of the toes.

9. A device according to claim 4, wherein said connections comprise an insert, affixing the device to the shoe at the sole, and the cover, affixed to the insert, completely or partially covers the front surface of the shoe upon application of a force by a user.

10. A device according to claim 9, wherein the insert and the cover form a journal, the insert constituting a fixed portion thereof, and the cover constituting a portion movable along a front-to-rear direction of movement.

11. A device according to claim 9, wherein said insert is implanted along an axis transverse to a longitudinal axis of the shoe.

12. A device according to claim 11, wherein the insert is implanted beneath or on opposite sides of said sole, in a zone demarcated at a front by a tip of a foot, at the rear by the front surface of a plantar arch, and laterally by the edges of the sole in their entire thickness.

13. A device according to claim 4, wherein said connections comprise retaining and immobilizing means on the shoe to fix an upper portion and/or a mid-portion of the device to the upper of the shoe.

14. A device according to claim 4, comprising a plurality of covers to be associated with the same shoe, said plurality of covers including said cover, said plurality of covers having respectively different rigidities.

15. A shoe comprising a stiffening device according to claim 4.

16. A device according to claim 4, wherein:

said cover is made of a rigid material along the entirety of the longitudinal extent of said cover.

17. A device according to claim 4, wherein:

said cover comprises a single piece of rigid material along the entirety of the longitudinal extent of said cover.

18. A device for flexural stiffening of an upper of a shoe, including a device for a sports shoe adapted to be fixed onto a sports apparatus, said device comprising:

a cover configured and arranged to cover a front surface of the shoe and to extend from a tibial support zone of the upper of the shoe, through a flexion fold zone of the upper of the shoe to a front end zone of a sole of the shoe;

said cover being made of a rigid or semi-rigid material in an entirety of a longitudinal extent of said cover;

at least one connection for connecting the cover to the upper of the shoe at at least one of the flexion fold zone and the tibial support zone;

a connection for connecting the cover between a top and a bottom of the sole for articulation of the cover relative to the sole;

said connection for connecting the cover for articulation including an insert, affixing the device to the shoe at the sole;

the cover, affixed to the insert, completely or partially covers the front surface of the shoe upon application of a force by a user;

the device being mounted to the shoe by means of a shaft and lateral inserts inserted to extend through all or part of the sole of the shoe.

19. An assembly comprising:

an article of footwear and a device for increasing flexural rigidity of the article of footwear;

said article of footwear including an upper and a sole, said upper including a flexion fold zone, a tibial support zone, and a front end zone;

said device including a cover covering said flexion fold zone of said upper of said article of footwear and extending forwardly from said flexion fold zone at least to said front end zone of said upper of said article of footwear;

said cover being rigid or semi-rigid at said flexion fold zone to increase flexural rigidity in said flexion fold zone, and said cover being rigid or semi-rigid at said front end zone;

said cover being connected at least to said upper at said flexion fold zone and/or at said tibial support zone;

said cover being connected to said sole by being articulated to said sole between a top and bottom of said sole beneath said front end zone of said upper of said article of footwear.

20. An assembly according to claim 19, wherein said cover extends from said tibial support zone to a zone of a metatarsophalangeal joint of the article of footwear and/or a zone of a base of the toes of the article of footwear.

21. An assembly according to claim 19, wherein said device further comprises at least one tightening strap extending rearwardly and downwardly at said flexion fold zone of the article of footwear for connecting said cover to said upper.

22. An assembly according to claim 19, wherein said device further comprises at least one tightening strap extending at least rearwardly from the tibial support zone of the article of footwear for connecting said cover to said upper.

23. An assembly according to claim 19, wherein said device further comprises at least one tightening strap extending at least rearwardly from the tibial support zone of the article of footwear and at least one tightening strap extending rearwardly and downwardly from said flexion fold zone of the article of footwear.

24. An assembly according to claim 19, wherein said cover is attached to a forward zone of said sole, said forward zone of said sole extending forwardly from a front end of a plantar arch of said sole.

25. An assembly according to claim 24, further comprising a fastening mechanism connecting said cover to said sole at a forward zone of said sole, said fastening mechanism connecting said cover to said sole only in said forward zone of said sole.

26. An assembly according to claim 19, wherein said cover is pivotally attached to a forward zone of said sole of said article of footwear, said cover being movable between a forwardmost open position and a rearwardmost closed position.

27. An assembly according to claim 26, wherein said upper of said article of footwear comprises a footwear tightening system, said cover at least partially covering said footwear tightening system in said closed position.

28. An assembly according to claim 19, wherein said sole comprises a plantar arch, and wherein said cover is spaced above said sole, at said plantar arch, a distance greater than a distance said cover is spaced above said sole at a front end zone of said article of footwear.

29. An assembly according to claim 19, wherein said cover is spaced above a median part of said sole a distance greater than a distance said cover is spaced above said sole at a front end zone of said article of footwear.

30. An assembly according to claim 19, wherein said upper of said article of footwear further comprises a closing zone having a longitudinally extending contour, wherein said cover has a lower edge having a longitudinally extending contour, and wherein said longitudinally extending contour of said lower edge of said cover generally follows said longitudinally extending contour of said closing zone.

31. An assembly according to claim 19, further comprising a plurality of covers, said plurality including said covers, said plurality having respectively different rigidities.

32. An assembly according to claim 19, wherein:

said cover is rigid or semi-rigid at said tibial support zone.

33. An assembly according to claim 19, wherein:

said cover is rigid at said front end zone, at said flexion fold zone, and at said tibial support zone.

34. An assembly according to claim 19, wherein:

said cover comprises a single piece of rigid material along an entirety of a longitudinal extent of said cover.

35. An assembly comprising:

an article of footwear and a device for increasing flexural rigidity of the article of footwear;

said article of footwear including an upper and a sole, said upper including a flexion fold zone, an upper front zone, an upper rear zone, and a front end zone, at least one portion of said upper is flexible;

said upper front zone of said upper being contiguous with and extending above said flexion fold zone in an upward direction to adapt the upper front zone to be positioned forward of a lower leg of a wearer of the article of footwear;

said upper rear zone of said upper extending in said upward direction to adapt the upper rear zone to be positioned rearward of the lower leg of the wearer of the article of footwear;

said front end zone of said upper extending in a direction forward of said flexion fold zone;

said device for increasing rigidity in flexion at least of said upper front zone folding toward said front end zone, said device comprising a cover having three parts, said three parts including an intermediate part, an upper part, and a lower part;

said intermediate part of said cover covering said flexion fold zone of said upper of said article of footwear;

said lower part of said cover extending forwardly from said intermediate part of said cover along an area above said front end zone of said upper of said article of footwear;

said upper part of said cover extending upwardly from said intermediate part of said cover along an area in front of said upper front zone of said upper of said article of footwear, said upper part of said cover extending substantially in said upward direction of said upper front zone and said upper rear zone of said upper of said article of footwear, said cover comprising a continuous rigid or semi-rigid material extending continuously from within said upper part, through said intermediate part, and within said lower part;

at least one of said intermediate and upper parts of said cover being connected to said upper of said article of footwear;

said lower part of said cover being connected to said sole, whereby said continuous rigid or semi-rigid material enables transmission of forces from a wearer's leg to said sole;

said lower part of said cover being connected to said sole by being articulated to said sole between a top and bottom of said sole beneath said front end zone of said upper.

36. An assembly according to claim 35, wherein:

said continuous rigid or semi-rigid material of said cover comprises a rigid material along an entirety of said upper part, an entirety of said intermediate part, and an entirety of said lower part.

37. An assembly according to claim 35, wherein:

said continuous rigid or semi-rigid material of said cover comprises a single piece of rigid material in said upper part, said intermediate part, and said lower part.

38. A snowboard boot assembly comprising:

a snowboard boot and a device for increasing flexural rigidity of said snowboard boot to improve transmission of forces from said snowboard boot to an attached snowboard;

said snowboard boot including an upper and a sole, said upper including a front end zone, a flexion fold zone, an ankle zone, and a portion extending above said ankle zone;

said device including a cover for increasing flexural rigidity of said snowboard boot, said cover being articulated to said sole of said snowboard boot at a front end zone of said sole between a top and bottom of said sole, and extending rearwardly to cover said flexion fold zone;

removable connections for connecting said cover at said flexion fold zone and/or at said portion extending above said ankle zone;

said upper of said snowboard boot being relatively flexible and said cover being relatively rigid in said front end zone, in said flexion fold zone, and in said portion extending above said ankle zone.

39. A snowboard boot assembly according to claim 38, wherein said cover is articulated to said sole only in said front end zone of said sole.

40. A snowboard boot assembly according to claim 38, further comprising a plurality of covers, said plurality including said cover, said plurality having respectively different rigidities.

41. A snowboard boot assembly comprising:

a snowboard boot adapted to be worn by a rider of a snowboard and fixed to a snowboard, said snowboard boot comprising:

a sole adapted to be supported on the snowboard;

an upper comprising:

a tibial support zone adapted to cover at least a front portion of a lower leg of a snowboarder;

a front end zone extending from a front end of the upper to an instep of the upper;

a flexion fold zone between said tibial support zone and said front end zone;

a front spoiler for increasing rigidity of flexion of said upper at least in said flexion fold zone for improving transmission of forces from the rider to the snowboard, said front spoiler being removably attached to said upper and extending in said tibial support zone, in said front end zone and in said flexion fold zone;

said front spoiler being attached to a forward zone of said sole at transversely spaced apart attachment points between a top and a bottom of said sole, said front spoiler comprising a rigid material to enable transmission of forces from said tibial support zone of said upper to said sole.

42. A snowboard boot assembly according to claim 41, wherein:

said spoiler comprises a semi-rigid material in said tibial support zone, in said front end zone and in said flexion fold zone.

43. A snowboard boot assembly according to claim 41, wherein:

said spoiler comprises a rigid material in said tibial support zone, in said front end zone and in said flexion fold zone.

44. A snowboard boot assembly according to claim 41, wherein:

said spoiler comprises one piece of material in said tibial support zone, in said front end zone and in said flexion fold zone.

45. A snowboard boot assembly according to claim 41, wherein:

said spoiler comprises a rigid material continuously extending from within said tibial support zone, through said flexion fold zone, and to within said front end zone.

46. A snowboard boot assembly according to claim 45, wherein:

said spoiler is articulated to said forward zone of said sole at said transversely spaced apart attachment points to enable the rider to move said spoiler between a closed position against said snowboard boot to an open position in which said cover is spaced away from at least said tibial support zone of said upper;

said spoiler has a shape corresponding that of said tibial support zone, said flexion fold zone, and said front end zone of said upper;

said cover has sufficient rigidity to retain said shape in said open position of said cover.

* * * * *